US006129593A

United States Patent [19]

Aoyama et al.

[11] Patent Number: 6,129,593

[45] **Date of Patent: *Oct. 10, 2000**

[54] BLOCK CONNECTOR

[75] Inventors: Masahiko Aoyama; Mitsugu Furutani, both of Yokkaichi, Japan

[73] Assignee: Sumitomo Wiring Systems, Ltd., Japan

[ * ] Notice: This patent is subject to a terminal disclaimer.

[21] Appl. No.: 09/425,425

[22] Filed: Oct. 22, 1999

Related U.S. Application Data

[63] Continuation of application No. 08/972,463, Nov. 15, 1997.

[30] Foreign Application Priority Data

Mar. 12, 1996 [JP] Japan ..... 8-323068

[51] Int. Cl.[7] ..... H01R 13/502

[52] U.S. Cl. ..... 439/701; 439/354

[58] Field of Search ..... 439/350–355, 439/357, 358, 701, 717

[56] References Cited

U.S. PATENT DOCUMENTS

| | | | |
|---|---|---|---|
| 3,848,951 | 11/1974 | Michaels et al. | 439/357 |
| 5,122,077 | 6/1992 | Maejima et al. | 439/717 |
| 5,320,555 | 6/1994 | Okabe | 439/701 |
| 5,643,015 | 7/1997 | Wakata | 439/701 |

FOREIGN PATENT DOCUMENTS 0 548 942 of 1993 European Pat. Off. .

*Primary Examiner*—Hien Vu

*Attorney, Agent, or Firm*—Anthony J. Casella; Gerald E. Hespos; Michael J. Porco

[57] ABSTRACT

To prevent deformation of lock portions and make a block connector smaller a dovetail-shaped lock groove 21 is formed at a front end of the upper surface of the lower housing 2 over the entire width, and a dovetail-shaped lock rib 22 which can be pressed into the lock groove 21 is formed on the lower surface of the upper housing 1. The lock rib 22 is divided into three divided ribs with clearances therebetween, and the projecting heights of the divided ribs differ. The lock groove 21 is formed to have a stepped shape. Recesses 32 which form jig insertion holes are so formed as to conform to the clearances of the lock rib 22. A rear locking mechanism is such that lock projections 30 are fitted into lock holes 29, and is relatively easily unlockable by rotating the front end of the upper housing 1. When the front ends of the upper and lower housings 1, 2 are disengaged by inserting a disengagement jig into the jig insertion hole, the lock rib 22 comes out of the lock groove while being guided by slanted side surfaces. If the front end of the upper housing 1 is subsequently rotated, the rear lock portion is also unlocked.

6 Claims, 7 Drawing Sheets

BLOCK CONNECTOR

This application is a continuation of U.S. patent application Ser. No. 08/972,463 filed Nov. 15, 1997.

BACKGROUND OF THE INVENTION

1. Field of the Invention

The present invention relates to a block connector having a plurality of housings disposed substantially one over another.

2. Description of the Prior Art

An example of a known block connector is shown in FIG. 12. This block connector is constructed by placing three connector housings "a" one over another. The rear half of the upper surface of each housing "a" is opened so that wires can be connected with unillustrated terminal fittings mounted in the housing "a". The upper housings "a" in each pair of adjacent housings "a" to be placed one over another are provided with lock portions "b" at front and rear ends of the opposite side surfaces, and the lower housings "a" in each pair of adjacent housings are provided with lock projections "c" so as to conform to the lock portions "b". When the respective housings "a" are placed one over another, the lock portions "b" are elastically engaged with the lock projections "c" of the housings "a" located below, with the result that the housings "a" are connected with each other for assembly into an integral block connector.

In the case that the block connector is disassembled for the maintenance, the lock portions "b" are disengaged from the lock projections "c" using a jig and the housings "a" are separated from each other.

In the above known block connector, since the lock means for holding the housings "a" connected are exposed on the outer surfaces of the housings "a", the lock portions "b" may be deformed or damaged if, for example, the block connector is struck against an other member. Further, the lock means bulge out from the side surfaces of the connector, making the connector wider as a whole.

To solve the above problem, an object of the present invention is to provide a block connector provided with improved lock means.

SUMMARY OF THE INVENTION

According to the invention, there is provided a block connector substantially constructed by placing or fitting a plurality of housings substantially one over another or to each other. A lock means comprising a lock projection and a lock recess into which the lock projection is pressed to effect locking are provided on substantially joining surfaces of the housings to be placed substantially one over the other. The lock projection and the lock recess are a rib and a groove, respectively, and continuously extend laterally or across or substantially from one side to the other of the joining surfaces of the housings.

The housings are integrally assembled by pressing the lock projection into the lock recess to effect locking. Since locking is effected by pressing the rib crossing the joining surface into the groove, a large locking area and a large holding force can be ensured. Further, since the rib, as the lock projection, has a large strength, the rib is not deformed during transportation before assembling.

Since the lock means is provided on or in the joining surfaces of the housings and is not exposed to the outside, inadvertent deformation and/or damage can be prevented. Further, since the lock means does not bulge out from the outer surfaces of the housings, the block connector can be made smaller as a whole.

According to a preferred embodiment, the lock means has a semilocking construction provided by a guide surface at least either on the lock projection or on the lock recess for guiding the lock projection and the lock recess in disengaging directions.

Since the lock means has a semilocking construction, the lock projection comes out of the lock recess along the guide surface when an external force acts to space the housings further apart, with the result that the housings are disengaged.

Preferably, the lock projection and the lock recess are a rib and a groove which substantially cross or preferably completely extend along the substantially widthwise direction of the joining surfaces of the housings, respectively.

Since locking is effected by pressing the rib crossing the joining surface into the groove, a large locking area and a large holding force can be ensured. Further, since the rib, as the lock projection, has a large strength, the rib is not deformed during transportation before assembling.

Further preferably, the rib is divided into divided ribs (or a plurality of small height ribs being formed on another small height rib extending from one side to the other) with a clearance formed therebetween and the insertion portion for the disengagement jig preferably is provided in a position substantially corresponding to the clearance.

The housings can be spaced wider apart by inserting the jig into the clearance between the divided ribs through the insertion portion. Since the housing disengaging operation is performed right in vicinity of the rib and the groove, the housing can be easily disengaged despite a large locking force.

Most preferably, the rib and the groove are formed to have a substantially stepped shape in which the height and/or depth varies in intermediate positions of or along their lengths.

By the contact of the stepped portions, the relative lateral displacement of the housings placed one over the other can be prevented.

According to a further preferred embodiment, there is provided a block connector substantially constructed by placing or fitting a plurality of housings substantially one over another or to each other. A lock means comprising a lock projection and a lock recess into which the lock projection is pressed or fitted or inserted to effect locking are provided substantially on joining surfaces of the housings to be placed substantially one over the other. The lock means has a semilocking construction by providing a guide surface at least either on the lock projection or on the lock recess for guiding the lock projection and the lock recess in disengaging directions or when being substantially disengaged from each other.

According to a preferred embodiment of the invention, an insertion portion for a disengagement jig is provided in at least one housing or between the housings placed substantially one over the other.

By spacing the housings wider apart by inserting the jig into the insertion portion, the lock projection comes out of the lock recess, thereby disengaging the housings. Thus, the housings can be disengaged easily.

The lock means comprising the lock projection and the lock recess are provided in a first position, preferably substantially at front ends or front end portions of the housings. A second lock means, which is lockable between the housings, is provided in a second position, preferably substantially at rear ends or rear end portions of the housings.

The first or front lock means preferably is unlocked by the operation of the jig in the insertion portion and the second or rear lock means preferably is unlockable by rotating the other or front end of the housing or by displacing the two housings with respect to each other, preferably along a non-linear path e.g. by rotation about a position at a distance or displaced from or in vicinity of the second or rear lock means.

Most preferably, the second or rear lock means comprises at least one lock portion and at least one lock projection. At least one of the lock portion and the lock projection is provided with at least one auxiliary disengagement guide surface for guiding the disengagement of the second or rear lock means.

According to a further preferred embodiment, the lock means comprising the lock projection and the lock recess is provided at front ends of the housings and another lock means which is lockable between the housings is provided at rear ends of the housings, and the front lock means is unlocked by the operation of the jig in the insertion portion and the rear lock means is unlockable by rotating the front end of the housing about a position in vicinity of the rear lock means.

Since the lock means are provided at the front and rear ends of the housings, the housings can be held more securely placed one over the other. After the front lock means is unlocked by operating the jig, the front lock means can be unlocked by rotating the front end of the unlocked housing.

In other words, the housings can be easily disengaged while being securely held placed one over the other.

These and other objects, features and advantages of the present invention will become more apparent upon a reading of the following detailed description and accompanying drawings.

DETAILED DESCRIPTION OF THE PREFERRED EMBODIMENTS

Hereafter, one embodiment of the present invention is described with reference to FIGS. 1 to 10.

Figure 1:
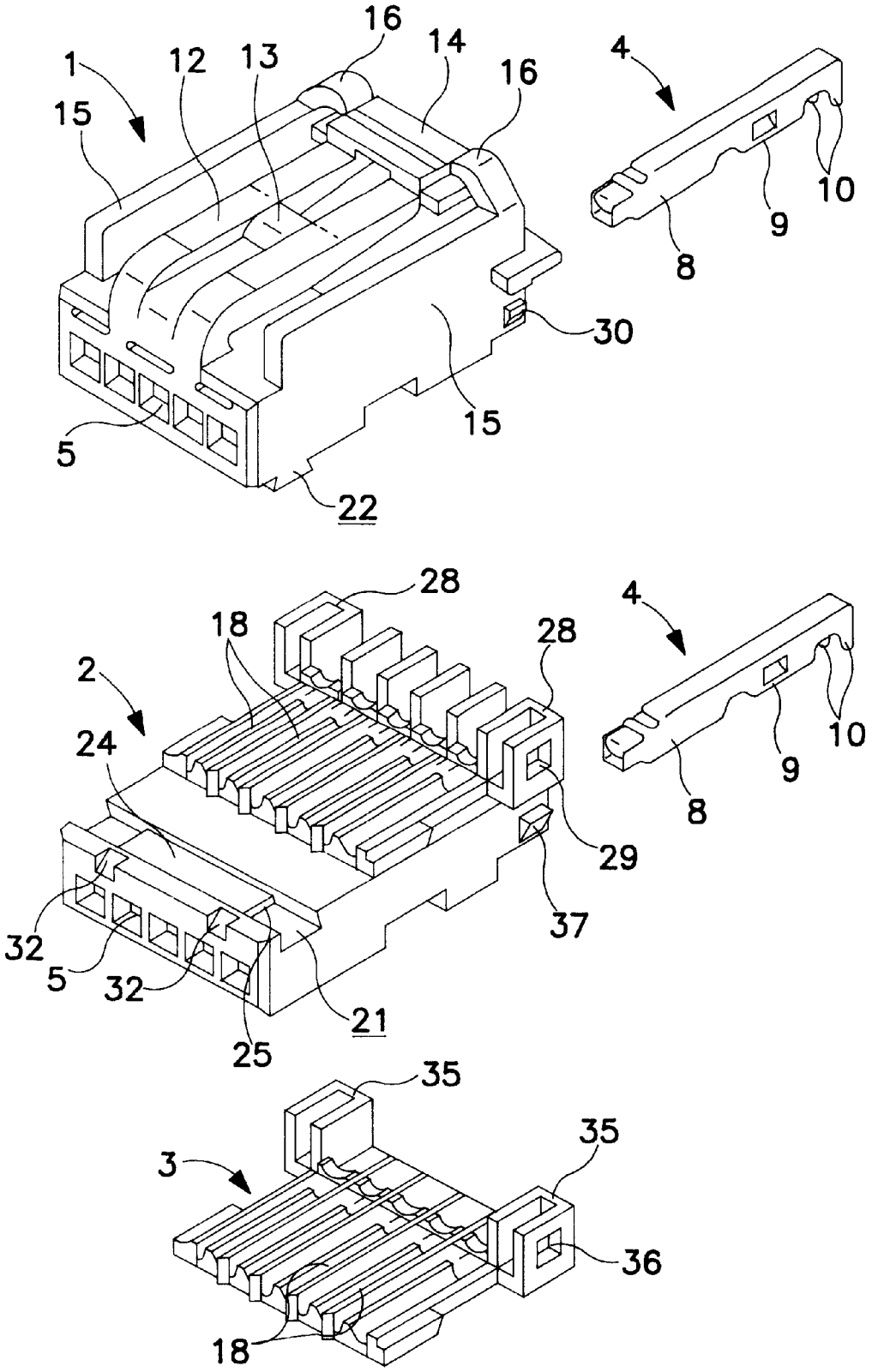
FIG. 1 is an exploded perspective view of a block connector according to one embodiment of the invention before being assembled.
Figure 2:
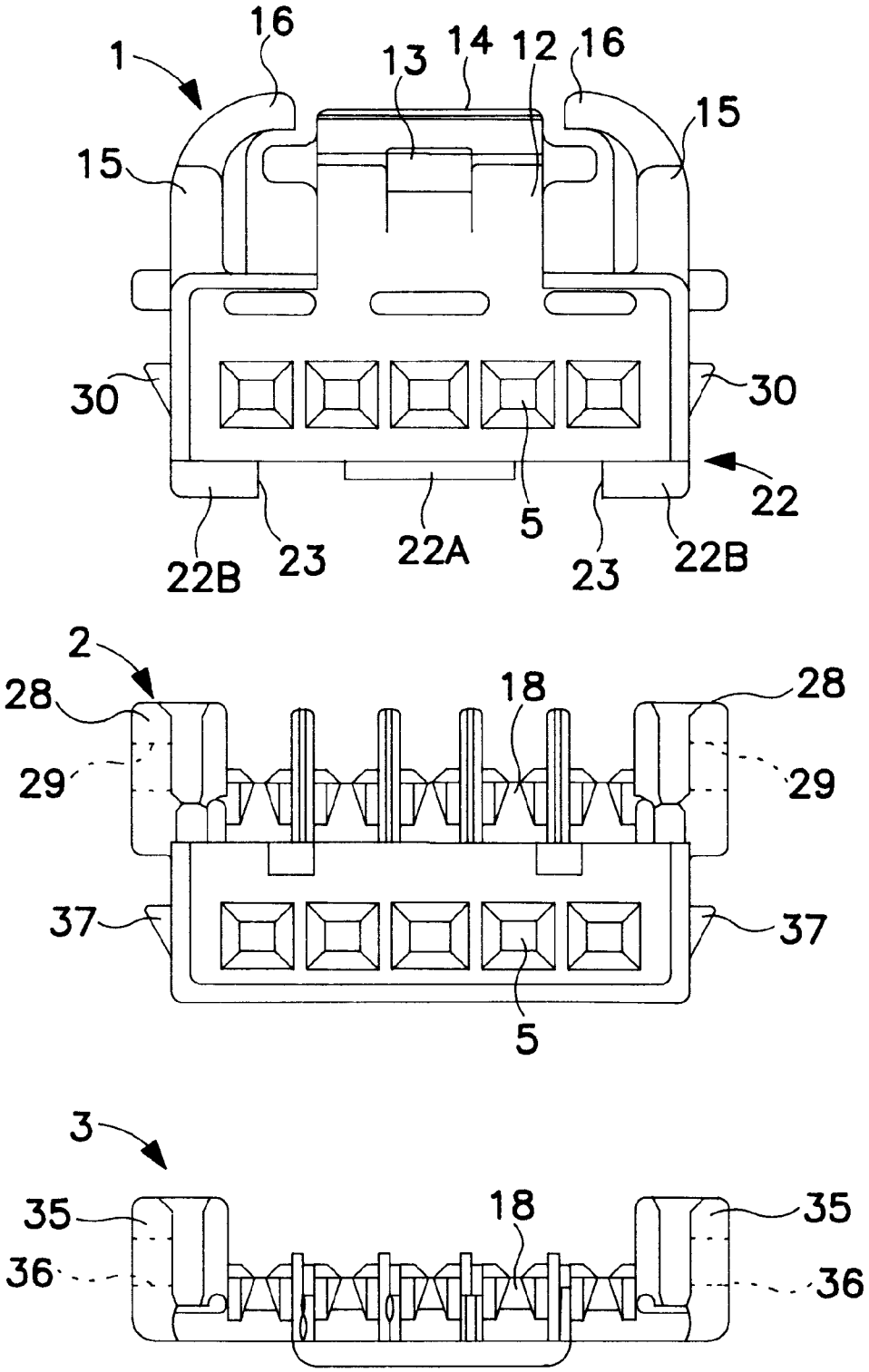
FIG. 2 is an exploded front view of the block connector in the assembled state.

A block connector according to this embodiment is a female connector, and, as shown in FIGS. 1 and 2, is constructed by placing an upper housing 1 over a lower housing 2 and mounting a cover 3 on the lower surface of the lower housing 2. The housings 1, 2 are formed such that wires W (see FIG. 7) can be connected with female terminal fittings 4 mounted in cavities 5.

First, the female terminal fittings 4 to be mounted in the respective housings 1, 2, are briefly described. Each female terminal fitting 4 is formed e.g. by bending a conductive metal thin plate. A connection portion 8, into which a tab of a corresponding mating male terminal fitting is to be inserted or fitted, is formed at a front side (left side in FIG. 1). A contact portion 9 is formed behind the connection portion 8 and is to be brought into pressing contact with the core of the wire and a barrel 10 is formed behind the connection portion 8 and is for fastening the insulation coating of the wire W.

The upper housing 1 is formed e.g. of a synthetic resin, and a plurality of cavities 5 are arranged preferably side by side inside the upper housing 1. The aforementioned female terminal fittings 4 are mounted by being inserted into the cavities 5 preferably from behind (right side in FIG. 1). The rear half of the lower surface of the upper housing 1 is open. An unillustrated connection jig can be inserted into the respective cavities 5 through this opening in the rear half of the lower surface of the upper housing, for connecting wires with the female terminal fittings 4 mounted in the cavities 5.

A lock arm 12 is formed on the upper surface of the upper housing 1 with one end of the lock arm is being fixed and the other end hanging. This lock arm 12 is formed with a lock projection 13 that is engageable with a mating connector housing and an unlock portion 14 which is or can be elastically deformed or displaced to disengage the connector housings. Further, protection walls 15 stand along the left and right edges of the upper surface of the upper housing 1 to prevent foreign matter from entering below the lock arm 14. Torsion or deflection or warp restricting portions 16 for preventing the lock arm 12 from twisting or deflecting or warping in a direction opposite to the disengaging direction of the lock arm 12 are provided at the rear ends of the protection walls 15.

The lower housing 2 also is formed e.g. of a synthetic resin, and a plurality of cavities 5 are arranged preferably side by side inside the lower housing 2 in a manner similar to the upper housing 1. The female terminal fittings 4 are mounted in the respective cavities 5 by being inserted thereinto preferably from behind. Similar to the upper housing 1, the rear half of the lower surface of the lower housing 2 is also open. A connection jig is insertable into the respective cavities 5 through this opening so as to enable the wire connecting operation with the female terminal fittings 4 mounted in the cavities 5.

A plurality of ribs 18 extending substantially along forward and backward directions are formed preferably side by side on the upper surface of the lower housing 2. By placing the upper surface of the lower housing 2 under the lower surface of the upper housing 1, the respective ribs 18 pressingly hold the wires W that are connected with the female terminal fittings 4 mounted in the upper housing 1.

The cover 3 also is formed of a synthetic resin and is dimensioned to substantially cover the opening of the lower housing 2. A plurality of substantially longitudinally extending ribs 18 are formed preferably side by side on the upper surface of the cover 3. When the cover 3 is mounted in a position to close the opening of the lower housing 2, the respective ribs 18 press the wires W that are connected with the female terminal fittings 4 mounted in the lower housing 2.

Subsequently, a locking mechanism for locking the upper and lower housings 1, is described. In this embodiment, two lock portions are provided at front and rear sides respectively.

Figure 3:
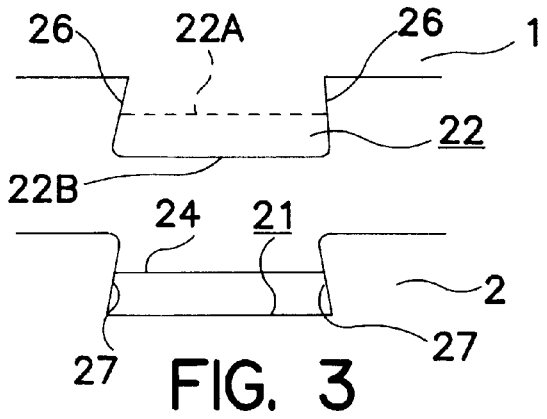
FIG. 3 is a partial side view of a lock groove and a lock rib being spaced apart.
Figure 4:
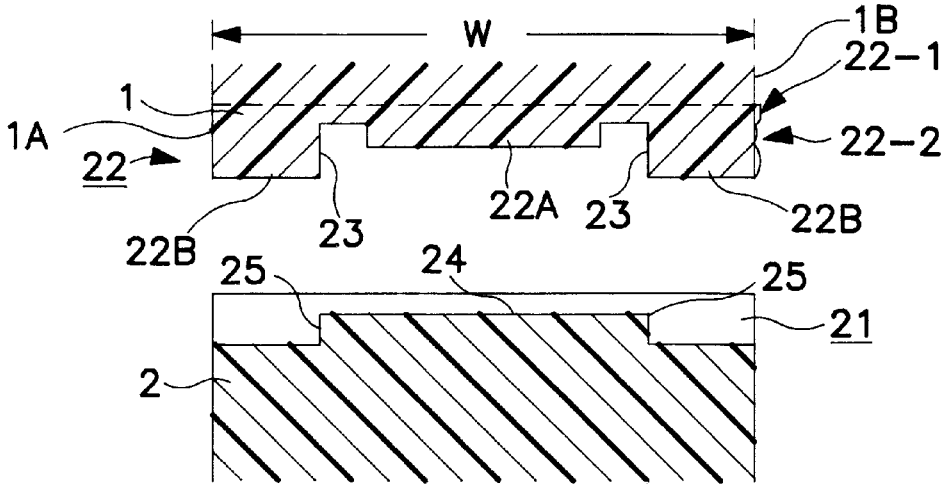
FIG. 4 is a section of the lock groove and the lock rib in their spaced apart state.

First, the construction of the front lock portion is described. The upper surface of the lower housing 2 is provided with a dovetail-shaped lock groove 21 at a specified distance from a front engaging surface. The dovetail-shaped lock groove 21, as shown in FIG. 3, extends over the entire width. On the other hand, in a corresponding position of the lower surface of the upper housing 1, a dovetail-shaped lock rib 22 is formed. The lock rib 22 is configured to be pressed or fitted or inserted into the lock groove 21 is formed. The lock rib 22 is divided into. preferably three sections which are spaced with clearances 23 therebetween as shown in FIG. 2, and a projecting height of a center divided rib 22A is smaller than that of divided ribs 22B at the opposite ends. Accordingly, the lock groove 21 is stepped such that the center portion is shallower than the opposite ends. Specifically, a shallow portion 24 is formed in an area between positions substantially corresponding to the inner end surfaces of the divided ribs 22B at the opposite ends as shown in FIG. 4. In other words, the lock rib 22 is subdivided into one rib portion 22-1 extending substantially from one side 1A to the other 2A of the upper housing 1 and one or more superposed or projecting rib portions 22-2, which project from the rib portion 22-1 substantially in the direction of the lower housing portion 2. Accordingly the superposed or projecting rib portion(s) 22-2 are interrupted, across the upper housing 1, and hence do not extend the entire width W (or across or from one side 1A to the other 1B of the upper housing 1.

The lock rib 22 is pressed into the lock groove 21 to be engaged therewith in such a manner that it does not come out of the lock groove 21. When an external force acts to separate the upper and lower housings 1, 2, the lock rib 22 can be pulled out of the lock groove by elastically opening the opening edge of the lock groove 21 and/or by deforming the lock rib 22 while being guided by slanted side surfaces 26, of the lock rib 22 and slanted side surfaces 27 of the lock groove 21. In other words, the front lock portion has a semilocking construction in which the slanted side surfaces 26, 27 serve as lock surfaces as well as disengagement guide surfaces.

Figure 6:
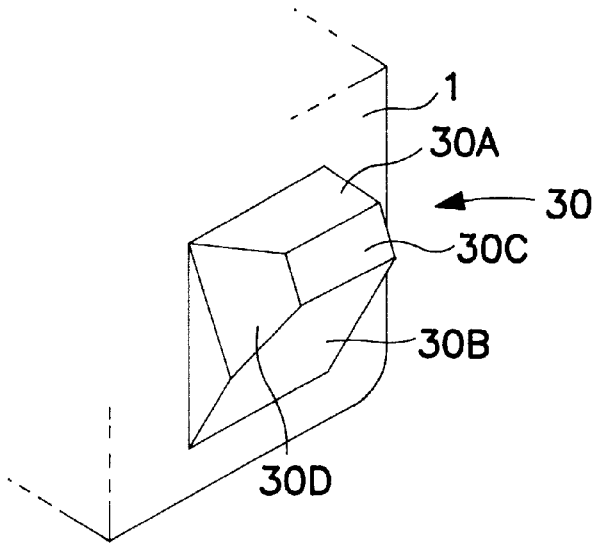
FIG. 6 is a perspective view of a lock projection of a rear lock portion.

Next, the construction of the rear lock portion is described. At the left and right ends of the rear end of the upper surface of the lower housing 2 are formed accommodating portions 28 for accommodating the rear ends of the left and right side walls of the upper housing 1. A substantially rectangular lock hole 29 is formed in the outer wall of each accommodating portion 28. On the other hand, lock projections 30, which are engageable with the lock holes 29, are formed at the rear ends of the left and right side surfaces of the upper housing 1. Each lock projection 30, as shown in FIG. 6, is formed with a lock surface 30A projecting substantially perpendicularly from the side surface of the upper housing 1 and a guide surface 30B which is slanted downwardly. A surface 30C is formed by bevelling the corner between the lock surface 30A and the guide surface 30B. And front end portion (e.g. the end portion toward the other lock means 21, 22) of the surface 30C is cut off obliquely (preferably laterally) or is bevelled to form a disengagement guide surface 30D.

Accordingly, when the upper housing 1 is placed on the lower housing 2, the lock projections 30 are or can be locked elastically with the lock holes 29. By constructing the lock projections 30 as above, the lock projections 30 come out of the lock holes 29 while being guided by the disengagement guide surfaces 30D when the housings 1, 2 are rotated in directions away from each other preferably about the rear ends thereof. In this case, it is sufficient that the center of rotation is located behind or at a distance or displaced from the lock projections 30, i.e. is located in a position where the lock projections 30 and the lock holes 29 can be disengaged from each other by a rotating operation.

Figure 7:
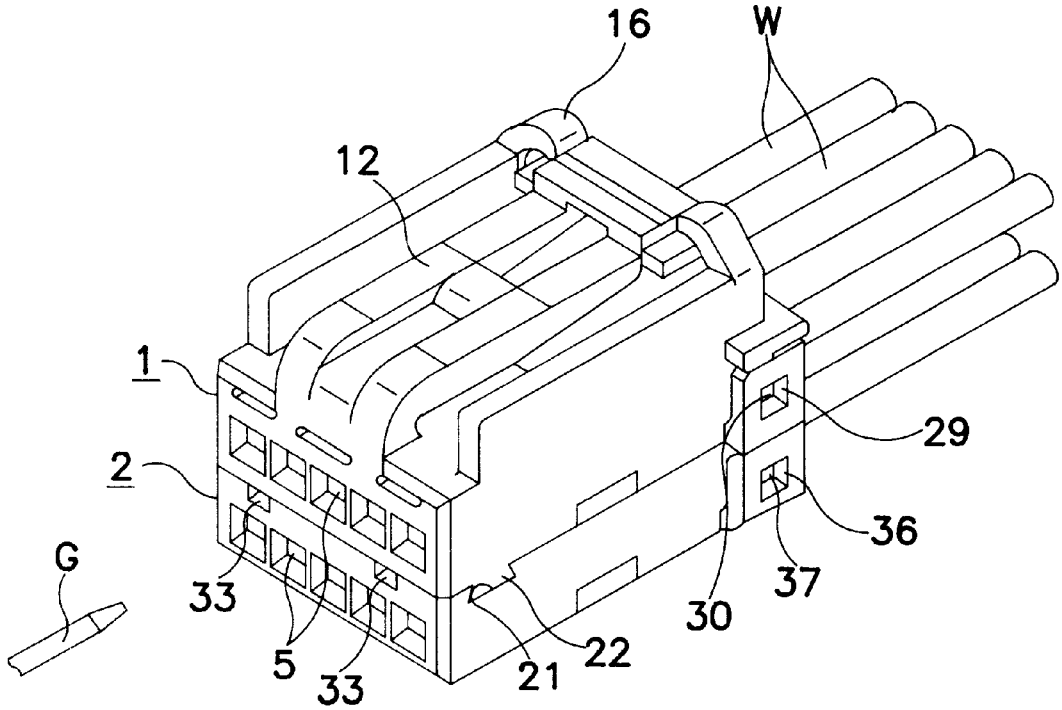
FIG. 7 is a perspective view of the assembled block connector.
Figure 8:
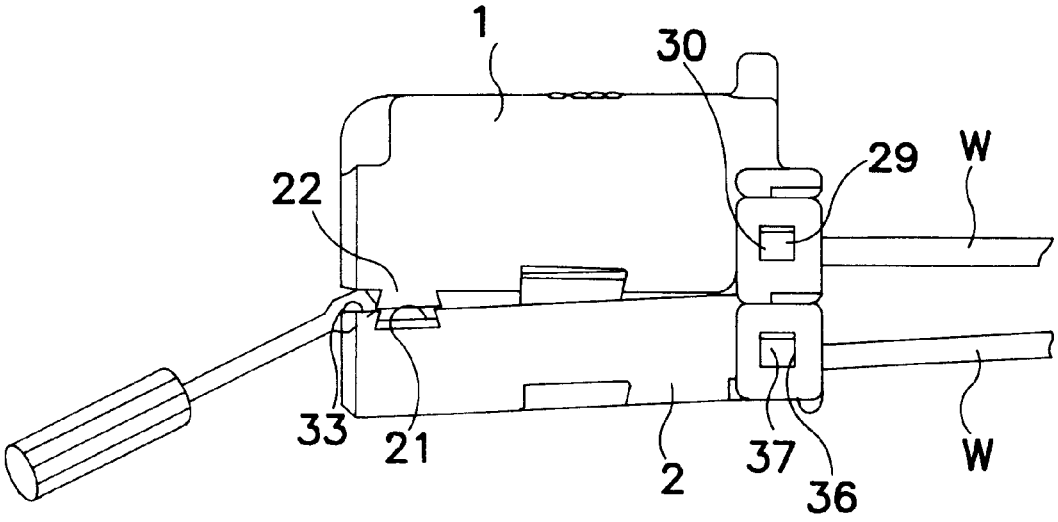
FIG. 8 is a side view showing a disengaging operation by a disengagement jig.

The front edge of the upper surface of the lower housing 2 is cut off obliquely preferably in two positions, thereby forming recesses 32 (FIG. 1). By placing the upper housing 1 on the lower housing 2, the recesses 32 are formed into jig insertion holes 33 for the insertion of a disengagement jig G as shown in FIG. 7. The respective jig insertion holes 33 are located in positions corresponding to or substantially in front of the intervals 23 between the divided rib 22A and the divided ribs 22B.

At the left and right ends of the rear end of the cover 3 are formed accommodating portions 35 for accommodating the rear ends of the left and right side walls of the lower housing 2. A lock hole 36 is formed in the outer wall of each accommodating portion 35. When the cover 3 is mounted in the position to cover the opening of the lower housing 2, lock projections 37 formed on the left and right side surfaces of the lower housing 2 are fitted into the lock holes 36.

The action of this embodiment constructed as above is described next.

The block connector is assembled as follows. First, the female terminal fittings 4 are mounted in the cavities 5 in the respective housings 1, 2, and the wires W are pressingly connected with the respective female terminal fittings 4 using the connection jig. The wires W connected with the female terminal fittings 4 are pulled out from the rear surfaces of the housings 1, 2.

Figure 5:
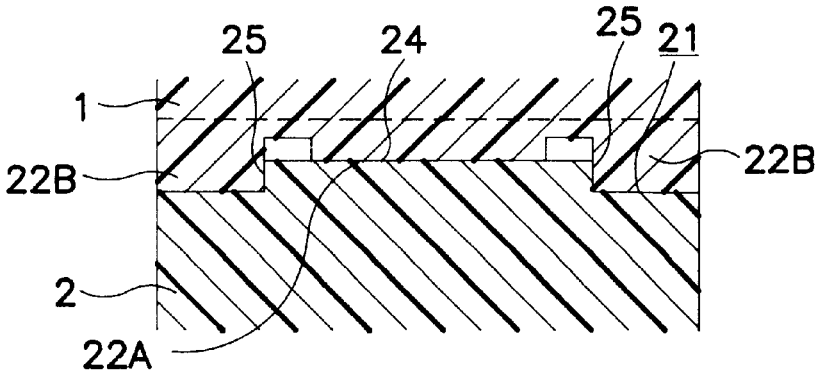
FIG. 5 is a section showing a state where the lock rib is pressed into the lock groove.

When the upper housing 1 is placed on the upper surface of the lower housing 2, the respective divided ribs 22A, 22B of the upper housing 1 are pressed into the lock groove 21 of the lower housing 2 while being compressed or deformed and/or while substantially widening the opening edge of the lock groove 21 as shown in FIG. 5 at the front side. On the other hand, at the rear side, the lock projections 30 of the upper housing 1 are fitted into the lock holes 29 by being guided by the guide surfaces 30B, and the lock surfaces 30A are engaged with the upper edges of the lock holes 29. In this way, the housings 1, 2 are held placed one over the other. By mounting the cover 3 on the lower surface of the housing 2, the assembling of the block connector is completed as shown in FIG. 7.

In this assembled state, a relative lateral displacement of the upper and lower housings 1, 2 is or can be prevented substantially by the abutment of the divided ribs 22B at the opposite sides against stepped surfaces 25 of the lock groove 21 as shown in FIG. 5.

The block connector assembled as above can be disassembled as follows for a repair or other necessity. First, as shown in FIG. 7, the leading end of the disengagement jig G is inserted into the jig insertion hole 33, and the disengagement jig G is so moved as to lift the upper housing 1. Then, the front ends of the housings 1, 2 are displaced in directions away from each other. Since the clearance 23 between the divided rib 22A and 22B is preferably located behind the jig insertion hole 33, the housings 1, 2 can be disengaged more efficiently from each other by prying the leading end of the disengaging jig G while being inserted into the clearance 23. As a result, the lock rib 22 comes out of the lock groove 21 while widening the opening edge of the lock groove 21 by being preferably guided by the slanted side surfaces 26, 27, thereby disengaging the lock rib 22 and the lock groove 21.

Figure 9:
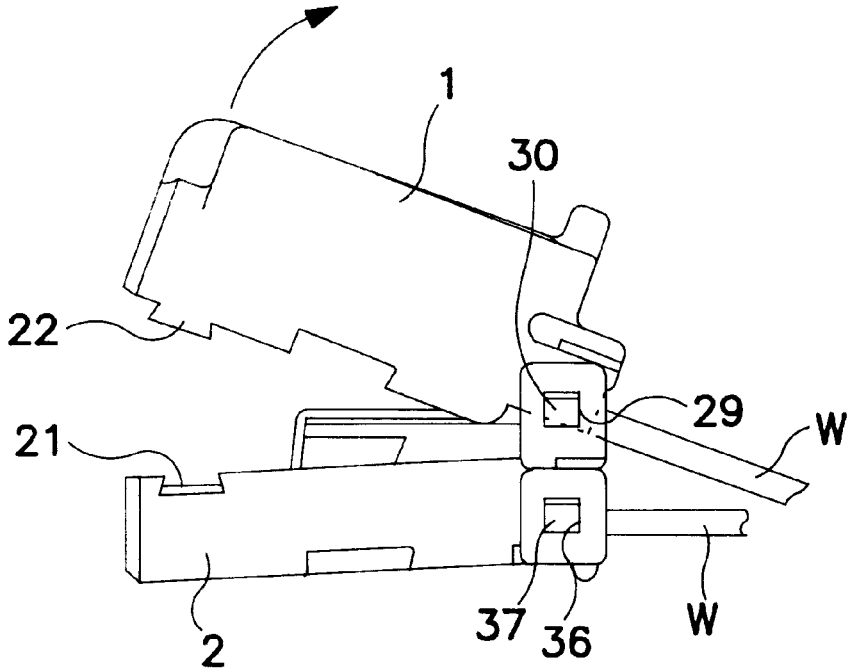
FIG. 9 is a side view showing a rotating operation.
Figure 10:
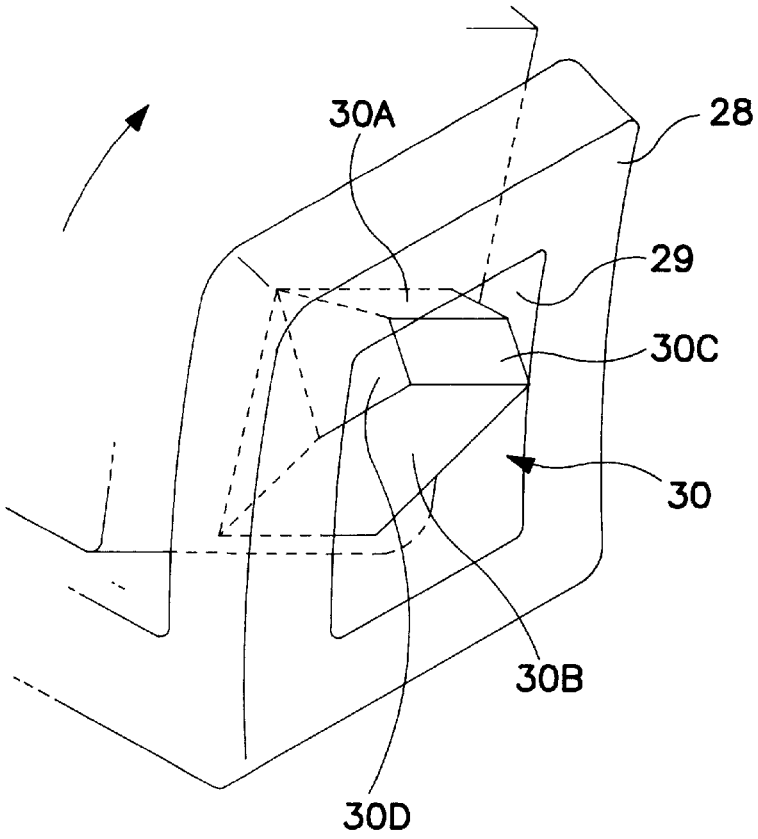
FIG. 10 is an enlarged perspective view showing an intermediate stage of the disengagement of the lock projection of the rear lock portion.

Subsequently, as shown in FIG. 9, the housings 1, 2 are so rotated about the rear ends or rear end portions thereof e.g. about an axis of rotation positioned at a distance from the lock projections 30 and/or lock holes 29, as to further open the front ends which have been pried open. Then, as shown in FIG. 10, the lock projections 30 provided at the rear side are guided by the disengagement guide surfaces 30D, and come out of the lock holes 29. In other words, the deflection or displacement of the accommodating portions 28 is sustained or facilitated by the slanted surface of the disengagement guide surfaces 30D. The lock projections 30 and the lock holes 29 at the rear side are disengaged from each other, and the housings 1, 2, can be completely separated from each other. In this way, the disassembling of the housings 1, 2, is completed.

As described above, this embodiment has following various advantages.

In the front lock portion, since the lock means (the lock rib 22 and the lock groove 21) is provided on the joining surfaces of the upper and lower housings 1, 2 which come together, it is not exposed to the outside. This prevents the lock means from being inadvertently deformed and/or damaged in the assembled state. Further, since the lock means does not bulge out from the side surfaces of the housings 1, 2, the width of the block connector can be made smaller.

The lock rib 22 and the lock groove 21 extending substantially over the entire width (preferably in a direction substantially normal to the longitudinal extension of the housings 1, 2 and/or terminal fittings 4) of the block connector ensure a large locking area. Accordingly, a high holding force can be obtained even with the semilocking construction. Further, since the lock rib 21 and the lock groove 21 are substantially coupled even in the substantially middle portion with respect to the widthwise direction of the joining surfaces of the housings 1, 2, there is no likelihood that the housings are spaced apart in the middle portion even in a connector having, e.g. a large width.

The provision of the jig insertion holes 33 facilitates the disengagement of the housings 1, 2 to unlock the front lock portion. Further, since the clearances 23 are provided in intermediate positions of the lock rib 22 so as to conform or correspond to the jig insertion holes 33, the disengagement jig G can be inserted even deeper and the jig insertion holes 33 can be pried in a position very close to the lock rib 22. Thus, the housings 1, 2 can be efficiently disengaged.

Furthermore, since the lock means are provided at the front and rear ends of the housings 1, 2, the housings 1, 2 can be more securely held placed one over the other. Even in such a case, after the front lock portion is unlocked using the disengagement jig G, the rear lock portion is unlocked by rotating the unlocked front end of the upper housing 1. Accordingly, the block connector can be easily disassembled. Further, since the jig insertion holes 33 are formed in the engaging surface located opposite from the side where the wires W are withdrawn, the wires W hinder neither the disengaging operation by the disengagement jig nor the rotating operation of rotating the front ends of the housings 1, 2. Thus, the disengaging operation can be performed easily even if the wires W are connected.

Further, the stepped lock rib 22 and lock groove 21 effectively prevent the relative lateral displacement of the upper and lower housings 1, 2 in their assembled state.

The cross sections of the lock groove and the lock rib may be as follows.

Figure 11:
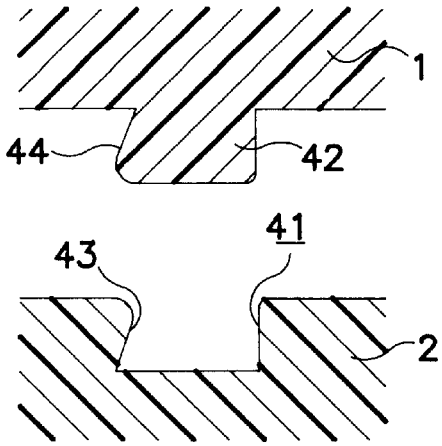
FIG. 11 is a section of a first modification of the lock groove and the lock rib.
Figure 12:
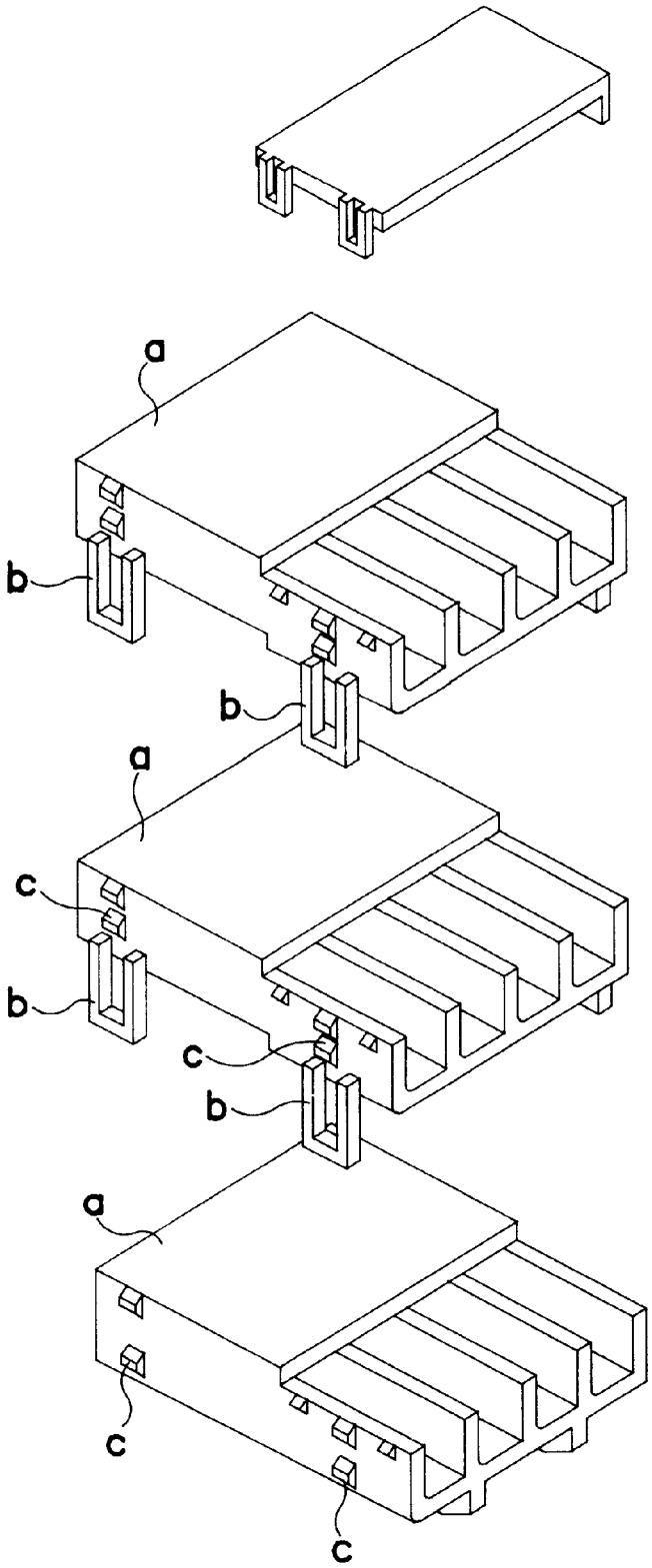
FIG. 12 PRIOR ART
FIG. 12 is an exploded perspective view of a prior art block connector.

In a first modification shown in FIG. 11, slanted surfaces 43 and 44 are formed only on one side surface of a lock groove 41 and on one side surface of a lock rib 42. These slanted surfaces 43, 44 serve as lock surfaces as well as guide surfaces.

The present invention is not limited to the described and illustrated embodiment, but the following embodiments also are embraced by the technical scope of the present invention as defined in the claims. Further, a variety of other changes can be made without departing from the scope and spirit of the invention as defined in the claims.

Converse to the foregoing embodiment, the lock groove may be formed in the upper housing and the lock rib may be formed on the lower housing.

The lock groove and the lock rib need not extend over the entire width. They may be provided in suitable positions along widthwise direction.

The lock groove and the lock rib may be provided along longitudinal direction normal to widthwise direction. In an extreme case, the lock groove and the lock rib may be a hole and a projection.

The guide surface for guiding the lock projection and the lock recess in disengaging direction may be provided only on one of the lock projection and the lock recess.

In a block connector in which the joining surfaces of the housings are closed substantially in their entirety as in a block connector of type in which cramping terminals are inserted, a locking mechanism comprised of a lock groove and a lock rib may be adopted at front and rear sides of the housings.

If the jig insertion holes are so formed as to communicate with or substantially correspond to the clearances between the divided ribs (e.g. by forming a through hole), the disengagement jig can be inserted deeper from the beginning, facilitating the disengaging operation.

The present invention is similarly applicable to a male block connector.

What is claimed is:

1. An electrical block connector assembly comprising:

a first connector housing having opposite front and rear ends and a plurality of substantially parallel terminal receiving cavities extending between the opposite front and rear ends, the first connector housing further comprising opposite left and right sides extending between the front and rear ends of the first connector housing and defining a width for the first connector housing, a first wall extending between the left and right sides of the connector housing and extending rearwardly from the front end of the first connector housing, the first wall having a first joining surface facing outwardly on the first connector housing, left and right dovetailed lock grooves being formed in the first joining surface, the left lock groove extending from the left side of the first connector housing to a center rib portion between the left and right sides of the first connector housing, the right lock groove extending from the right side of the first connector housing to the center rib portion, such that the left and right lock grooves are spaced from one another by the center rib portion, the center rib portion having left and right stepped surfaces extending away from the first joining surface and the respective left and right lock grooves, such that said left and right lock grooves terminate at the left and right stepped surfaces between the respective left and right sides of the first connector housing; and a second connector housing having opposite front and rear ends and a plurality of substantially parallel terminal receiving cavities extending through the second connector housing from the rear end to the front end thereof, the second connector housing further having opposite left and right sides extending between the front and rear ends of the second connector housing, the left and right sides of the second connector housing defining a width substantially equal to the width of the first connector housing, the second connector housing having a second wall extending between the left and right sides of the second connector housing and extending rearwardly from the front end of the second connector housing toward the rear end thereof, the second wall having a second joining surface facing outwardly on the second connector housing, the second joining surface being formed with spaced apart left and right dovetailed lock ribs, the left lock rib extending from the left side of the second connector housing to a left lock rib end disposed between the right lock rib and the left side of the second connector housing, the right lock rib extending from the right side of the second connector housing to a right lock rib end disposed between the left lock rib and the right side of the second connector housing, the left and right lock ribs of the second connector housing being releasably locked in the respective left and right lock grooves of the first connector housing by urging the first and second connector housings toward one another along directions substantially perpendicular to the first and second joining surfaces, such that the left and right sides of the first connector housing are aligned respectively with the left and right sides of the second connector housing and such that the left and right ends of the respective left and right lock ribs abut the respective left and right stepped surfaces of the center rib portion formed between the left and right lock grooves in the first connector housing, whereby the releasable locked engagement of the lock ribs in the lock grooves substantially prevents inadvertent separation of the second joining surface away from the first joining surface, and whereby the engagement of the left and right ends of the respective left and right lock ribs with the left and right stepped surfaces of the center rib portion of the first connector housing prevents relative sliding movement of the second joining surface on the first joining surface.

2. The electrical block connector assembly of claim 1, wherein the left and right lock grooves are elongated and are aligned substantially orthogonal to the respective left and right sides of the first connector housing, and wherein the respective left and right lock ribs of the second connector housing are elongated and are aligned substantially orthogonal to the respective left and right sides of the second connector housing.

3. The electrical block connector assembly of claim 2, wherein the left and right lock grooves are substantially colinear with one another, and wherein the left and right lock ribs are substantially colinear with one another.

4. The electrical block connector assembly of claim 3, wherein the left and right lock grooves are at locations on the first connector housing closer to the front end of the first connector housing than to the rear end thereof, and wherein the left and right lock ribs of the second connector housing are disposed at locations closer to the front end of the second connector housing than to the rear end thereof.

5. The electrical block connector assembly of claim 4, further comprising left and right rear lock holes formed on the respective left and right sides of the first connector housing at locations in proximity to the rear end of the first connector housing, and wherein the second connector housing has left and right rear lock projections disposed on the respective left and right sides of the second connector housing at locations in proximity to the rear end of the second connector housing, the rear lock holes of the first connector housing being releasably locked with the respective left and right rear lock projections on the second connector housing.

6. The electrical block connector assembly of claim 1, wherein the left and right lock ribs of the second connector housing and portions of the first connector housing adjacent the respective left and right lock grooves are elastically deformable for enabling locked engagement of the lock ribs in the lock grooves in response to movement of the first joining surface and the second joining surface toward one another.

* * * * *